US006513306B1

(12) United States Patent
Milano

(10) Patent No.: US 6,513,306 B1
(45) Date of Patent: Feb. 4, 2003

(54) METHOD AND A DEVICE FOR WRAPPING A PRODUCT IN A WRAPPER MADE OF SHEET MATERIAL, AND THE CORRESPONDING WRAPPED PRODUCT

(75) Inventor: Giuseppe Milano, Alba (IT)

(73) Assignee: Soremartec S.A., Schoppach-Arlon (BE)

( * ) Notice: Subject to any disclaimer, the term of this patent is extended or adjusted under 35 U.S.C. 154(b) by 0 days.

(21) Appl. No.: 09/557,897

(22) Filed: Apr. 21, 2000

(30) Foreign Application Priority Data

Apr. 23, 1999 (EP) ..... 99830242

(51) Int. Cl.[7] ..... B65B 47/00

(52) U.S. Cl. ..... 53/453; 53/559; 53/461; 53/221

(58) Field of Search ..... 53/453, 559, 461, 53/221

(56) References Cited

U.S. PATENT DOCUMENTS

| | | | | |
|---|---|---|---|---|
| 4,510,735 A | | 4/1985 | Cillario | |
| 5,443,546 A | * | 8/1995 | Bertalero | 53/453 |
| 5,729,962 A | * | 3/1998 | Dirx | 53/461 |
| 5,775,060 A | * | 7/1998 | Ferrero | 53/453 |

FOREIGN PATENT DOCUMENTS

| | | |
|---|---|---|
| DE | 3243500 | 5/1984 |
| EP | 082952 | 7/1983 |
| EP | 591742 | 4/1994 |
| EP | 790184 | 8/1997 |

* cited by examiner

*Primary Examiner*—Rinaldi I. Rada
*Assistant Examiner*—Gloria R Weeks
(74) *Attorney, Agent, or Firm*—Rothwell, Figg, Ernst & Manbeck

(57) ABSTRACT

The wrapper which surrounds the product is formed from two pieces, for example, of thin aluminium foil. The first piece is shaped to a generally cup-shaped configuration so as to house the product substantially completely also leaving a projecting edge in the region of the mouth portion of the cup-shaped configuration. The second piece, which retains a substantially flat configuration, is applied and welded to the projecting edge. The rim formed as a result of the connection of the two pieces is then subjected to a shaping operation against the product, conferring on the rim a generally case-like configuration. A case-like housing body with a flat base wall which can support the product is thus formed, the case-like housing body being constituted by an integral part of the wrapper.

39 Claims, 3 Drawing Sheets

14
10
11
12
13
17
18
19
20
21
22
1
2
d
S

METHOD AND A DEVICE FOR WRAPPING A PRODUCT IN A WRAPPER MADE OF SHEET MATERIAL, AND THE CORRESPONDING WRAPPED PRODUCT

The present invention relates to a method and to a device for wrapping a product in a wrapper made of sheet material according to the preambles to claims 1 and 16. The invention also relates to the corresponding wrapped product, according to the preamble to claim 31.

A method, a device and a product of this type are known, for example, from EP-A-0 591 742. A somewhat similar solution is known from EP-A-0 790 184.

Basically, the solutions described in these documents are intended to produce a wrapper made of sheet material which surrounds the product quite closely (the product is typically constituted by a food product such as a confectionery product, for example, a praline or a chocolate).

Figures 5, 6, 7:
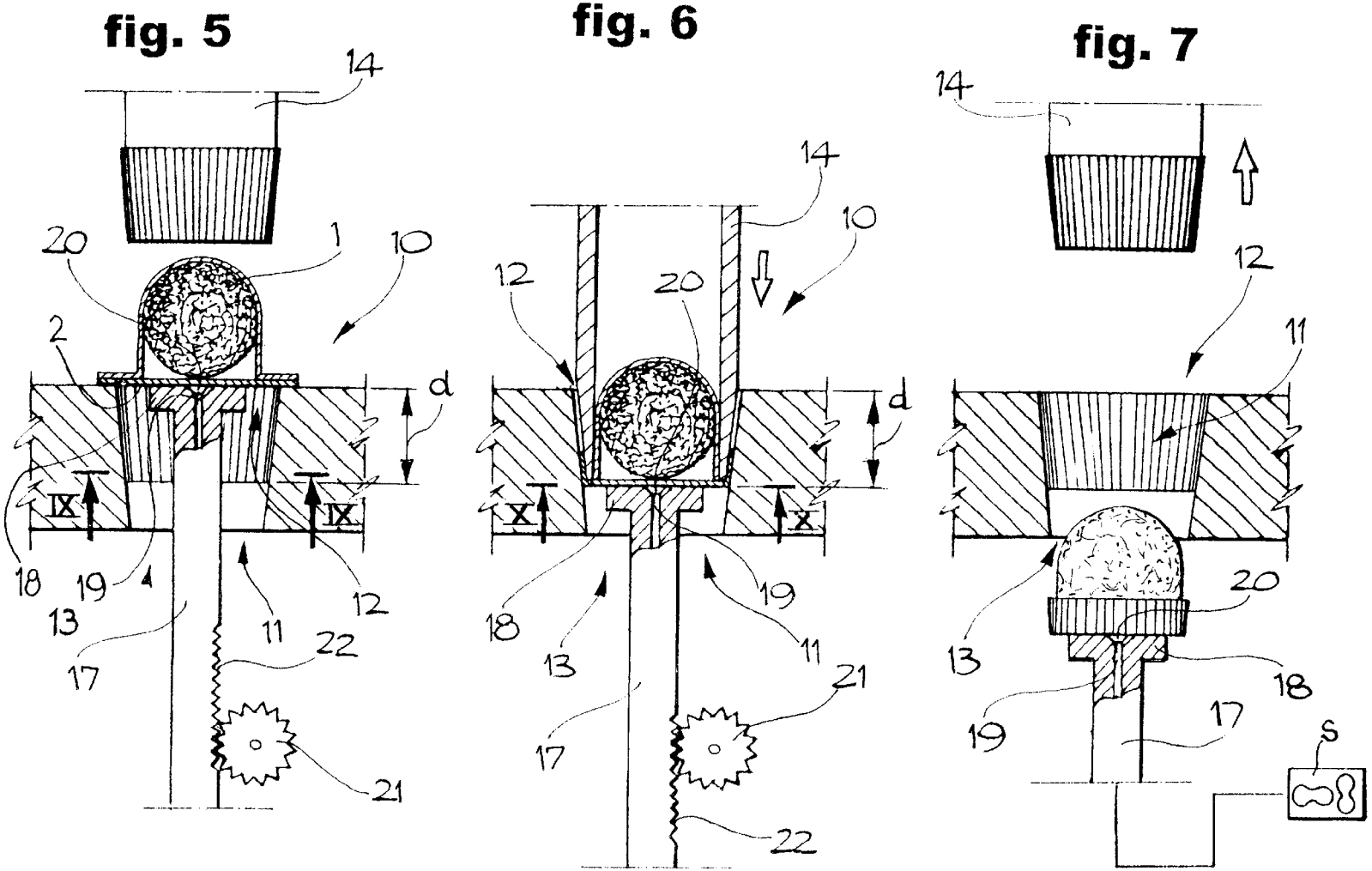

The product wrapped in the wrapper is usually intended to be inserted in a small case with a pleated peripheral wall (commonly known as a "petit four case") in order to render its presentation more pleasing and attractive; in this connection reference may be made to FIG. 7 of EP-A-0 591 742.

It appears, however, that this solution, which has been implemented with great success for some years (and also more conventional wrappers such as those described in EP-A-0 082 952) could be improved from various points of view.

In the first place, the use of the small case requires two additional sets of operations to be performed during the packaging of the product, that is: those inherent in the production of the case and those inherent in the insertion of the product in the case. To ensure and to maintain the precise positioning of the product wrapped in the wrapper relative to the case, it is often necessary to provide locating means such as, for example, a drop of adhesive material which connects the bottom portion of the wrapper of the product to the upper face of the base wall of the case. This results in a need to perform at least one further additional operation during the packaging stage.

When the product is consumed, after it has been removed from the case and the wrapper has been opened/torn, the case constitutes purely and simply an item of refuse to be thrown away in addition to the wrapper. Whereas the latter is usually made of sheet material, typically aluminium foil, which can easily be rolled into a ball and reduced to a minimal size, owing to the pleated structure of its peripheral wall, the case has a certain firmness which hampers its disposal to a certain extent.

The object of the present invention is to provide a solution which enables the above-mentioned improvements to be achieved easily and economically.

According to the present invention, this object is achieved by means of a method, a device and a wrapped product having the characteristics recited in the following claims.

Figure 8:
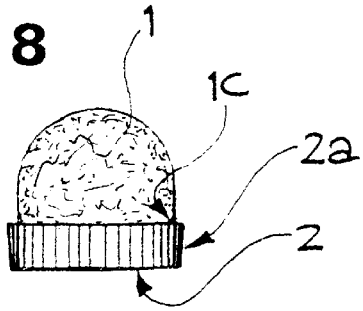
Figure 9:
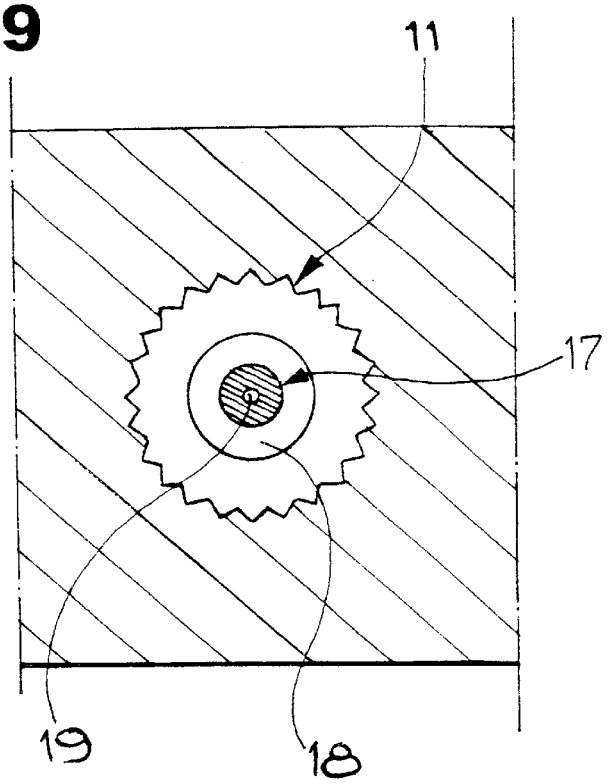
Figure 10:
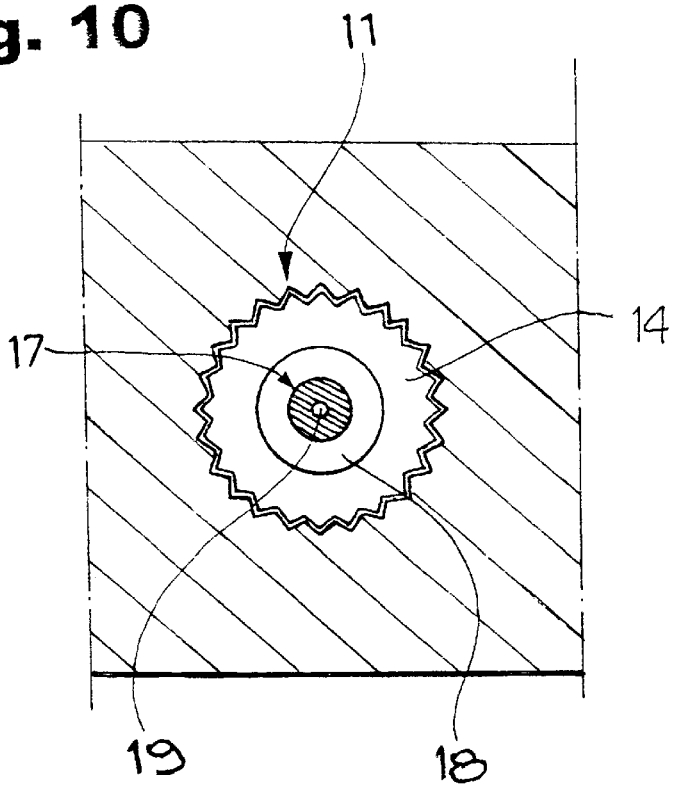

The invention will now be described, purely by way of non-limiting example, with reference to the appended drawings, in which:

FIGS. 1 to 7 show schematically and in sequence some steps of the method according to the invention, FIG. 8 shows the final product produced by the method shown schematically in the preceding drawings, and FIGS. 9 and 10 show further details of a device according to the invention already shown partially in FIGS. 5 to 7; FIGS. 9 and 10 may thus be considered as sections taken on the lines IX—IX of FIG. 5 and X—X of FIG. 6, respectively.

Basically, the steps shown in FIGS. 1 to 4 do not differ substantially from the steps shown in the corresponding FIGS. 1 to 4 of EP-A-0 591 742.

In particular, the product to be wrapped is constituted, in the embodiment illustrated, by a generally spherical praline P. For example, this may be a praline constituted by a spherical wafer shell with a soft or creamy filling, coated externally with chocolate, for example, with hazelnuts, or similar coatings, possibly with the application of grated coconut, chopped nuts, etc., which give the external surface of the praline P a generally irregular appearance.

The invention may, however, be applied to products of a completely different nature and shape. Still within the confectionery industry, hollow or solid chocolate eggs, various chocolates, pralines of approximately spherical shape with a flat base wall, small meringues, etc., may be mentioned.

According to the invention, two pieces 1 and 2 of aluminium foil or other sheet material are used to form a close-fitting and sealed wrapper around the product P.

The selection of aluminium foil is considered preferable because it has the ability to be fitted easily around the product P and to be shaped easily, in combination with substantially plastic behaviour. Usually, the two pieces 1 and 2 are preferably covered, on their opposed inner surfaces which are intended to face towards the product P, with a lacquer or a layer of hot-melting material.

The reasons for this will become clearer from the following. This also applies to the fact that the two wrapping pieces 1, 2 do not have the same dimensions; the first piece, indicated 1, in fact usually has much larger dimensions than the piece 2.

The first step in the packaging of the product P consists of an operation to shape the piece 1 into a generally dished or cup-like configuration (possibly by drawing). This operation is usually performed by means of a tool comprising a die 3 defining an internal cavity 3*a* which can be penetrated by a punch 4. For a general description of the possible criteria for the production of a shaping tool of this type, reference may usefully be made to DE-A-32 43 500. The cavity 3*a* and the active portion of the tool 4 have complementary surfaces for shaping the piece 1 by pressing it between them. In particular, the cavity 3*a* of the die is generally "deeper" than would suffice simply to shape the piece 1 in a manner complementary with the respective half portion of the product P. In practice, the cavity 3*a* has a depth such that, once the piece 1 has been shaped like a cup, it can house the product P almost entirely.

Figure 1:
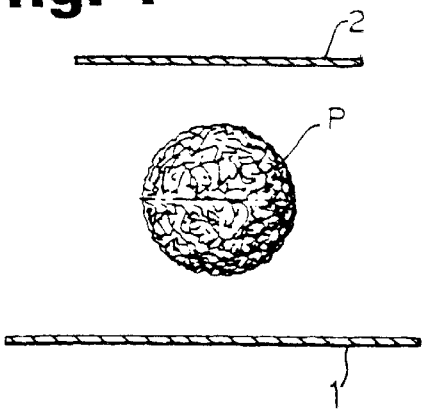
Figure 2:
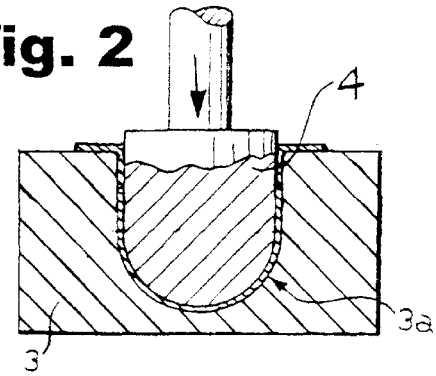
Figure 3:
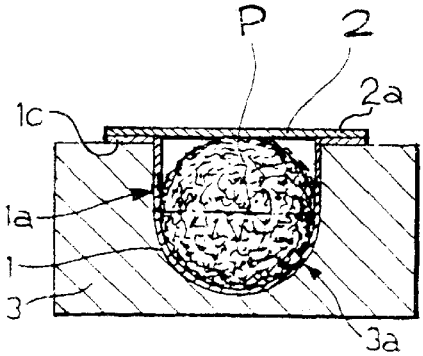

The effect of the configuration adopted for the cavity 3*a* and for the punch 4 is in fact precisely such as to cause the piece of aluminium foil 1 to be shaped with a generally dished or cup-like configuration so that it can house the product P, as shown schematically in FIG. 3. In this drawing, it is assumed that the product P is inserted in the piece 1 when the latter is still inside the drawing die 3. Naturally, this selection should not be considered essential in the sense that, after the piece 1 has been shaped like a cup, it may be removed from the die 3 and transferred into another die or into another element with a cavity for supporting the piece 1 for the insertion of the product P.

Whichever selection is adopted, it will be noted that, once the product P has been inserted in the cup-shaped piece 1, the product P does not project, or projects only minimally, above the plane of the opening of the housing cup defined by the piece 1.

The overall dimensions selected for the piece 1 are such that, once the piece 1 has been shaped, in addition to a hemispherical base portion for housing the lower hemispherical portion of the product P, it also comprises a neck portion, indicated 1*a*. The neck portion 1*a* extends so as to cover the opposite (upper) hemispherical portion of the product P—although not closely adhering thereto. In other words, the piece 1 is shaped so as to be able to house the product P substantially in its entirety. The neck portion la is extended further beyond and outside the opening portion of the cavity 3*a* by a peripheral portion 1*c* which retains its flat shape (possibly with pleating due to the cup-like shaping).

Once again, it is pointed out that the reference to hemispherical portions relates to the example of use illustrated, of a product P constituted by a substantially spherical praline. However, the same remarks apply in identical manner if oval or elliptical portions or portions of mixed shape are involved rather than spherical portions.

In these conditions (that is, in the position shown in FIG. 3) the other piece 2 is then applied to the product P.

In general, the piece 2 is simply placed on the upper portion of the product P, thus retaining its original flat shape both in its central region and in its peripheral region 2*a* which can be superimposed on the similarly flat peripheral portion 1*c* of the piece 1.

At this point, the pieces 1 and 2 which have been fitted tightly together along the outline of the opening portion of the cavity 3*a*, are welded W (and possibly also cut, i.e. blanked) by means of a tool 6. This takes place in the homologous peripheral regions indicated 1*c* and 2*a*.

Figure 4:
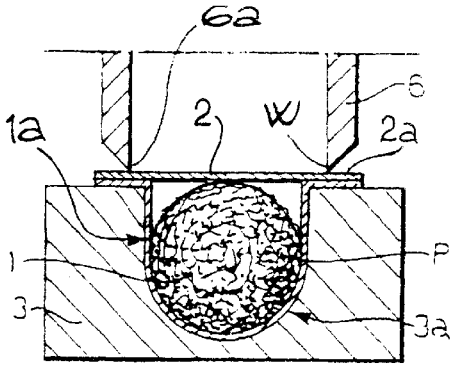

Naturally, although a single tool 6 is shown in FIG. 4, instead of being performed simultaneously, the two operations described above (welding and cutting) may also be performed in two successive steps with the use of two different tools, typically by performing the cutting operation after the welding operation.

The welding of the two pieces 1 and 2 in the regions 1*c* and 2*a* is intended to seal the foil wrapper formed around the product P from the exterior, thus preventing the product from coming into contact with the air and possibly being altered.

In order to perform the welding, it is possible to use, for example, gluing with added material, or (in accordance with a greatly preferred solution) heat-sealing, preferably performed by bringing about fusion (by the direct application of heat or by the application of ultrasound vibrational fields) of a hot-melting coating (a lacquer) or of a heat-sealing material provided on the inner faces of the pieces 1 and 2.

This result can be achieved, for example, by means of a heat-sealing tool such as those used, for example, for applying aluminium sheets coated with hot-melting material to the mouth portions of cup-like containers containing liquid or semi-liquid products (for example yoghurt or similar products).

The operation to cut the edge regions 1*c* and 2*a* which have been welded together may be formed by a punch-like tool, of which the cutting edge, indicated 6*a* in FIG. 4, extends along a path (a circular path in the embodiment shown, in which the product P is spherical) which extends around the rim of the opening portion of the cavity 3*a* externally.

The welding may be performed together with the cutting, also thermally, by arranging for the cutting tool also to be heated so as to bring about local fusion of the hot-melting material applied to the aluminium sheets.

In any case, it can be appreciated that the tool or tools act on the homologous regions 1*c* and 2*a* of the coupled pieces 1, 2, forming a generally closed wrapper around the product P. The wrapper is produced by a single positive shaping operation (that is, that performed on the piece 1 during the step illustrated in FIG. 2).

The solution described has also been found excellent in relation to the need to prevent the wrapper formed around the product P as a result of the connection of the pieces 1 and 2 from retaining appreciable quantities of air in its interior, between the outer wall of the product P and the inner wall of the closed wrapper, which could possibly bring about deterioration of the product or even bulging of the final package produced.

In comparison with the solution described in EP-A-0 591 742, the solution described herein is characterized by the way in which the operation to shape the first piece 1 is performed. In fact this operation is performed, in this case, in a manner such that, once the product P is inserted in the piece 1 as shown schematically in FIG. 3, it is completely or almost completely housed in the piece 1, in any case without having appreciable parts extending beyond the plane of the opening edge of the cup-shaped piece 1. As a result, once the second piece 2 has been fitted on the piece 1 and connected thereto by virtue of the welding of the homologous regions 1*c* and 2*a*, it retains a substantially flat shape.

At this point, in contrast with what occurs in the solution described in EP-A-0 591 742, the edge region in which the connection between the two pieces 1 and 2 is formed, is not folded closely against the product P and the remaining portion of the wrapper. On the contrary, this region is subjected, by means of a shaping device generally indicated 10, to an operation substantially corresponding to the formation of the case for housing the product P as an integral part of the wrapper produced as a result of the operation to shape the connecting rim between the two pieces 1 and 2, which is constituted by the homologous regions 1*c* and 2*a*. In particular, this rim constitutes the peripheral wall of the case-like element. In this connection, reference should be made to FIG. 8, from which it can also be seen that, by operating in the manner described, the portion (the flat portion) of the piece 2 surrounded by the rim in which the pieces 1 and 2 are connected in fact constitutes the base portion of the housing case.

The advantages of this solution are clear.

In the first place, it is not necessary to form the case as a separate element; according to the invention, the case is in fact constituted by portions (the piece 2 and the portion 1*c* of the piece 1) of the same wrapper which surrounds the product. At the same time, the product P is automatically already positioned in the case upon completion of the operation to form and seal the wrapper. In particular, the wrapper has the characteristics of hermetic sealing and protection of the product from the outside environment as already discussed in EP-A-0 591 742.

In the second place, the product P can retain precisely its position in the wrapper and in the case formed as an integral part of the wrapper without the need to provide, for example, spots of adhesive material for holding the product in place relative to the case.

Finally, at the time of consumption, in order to reach the product P, it suffices to tear the wrapper (including the case) and the torn wrapper can then easily be folded up and reduced to minimal dimensions, preventing the problem of an additional item to discard.

FIGS. 5 to 7 show, by way of example, a currently-preferred embodiment of the method according to the invention.

For this purpose, the shaping device 10 used to perform the operation to form the "integral" case comprises, in the first place, a moulding (or forming) cavity 11. The cavity is constituted substantially by a cavity (for example, formed in a metal plate, although, naturally, the use of moulded elements of another type is possible) having a shape which is generally tapered between an input opening or mouth 12 and an expulsion opening or mouth 13; the latter has generally smaller dimensions than the input opening 12.

Usually, the above-mentioned openings and the tapered wall of the moulding cavity 11 extending between them (in this connection see also the sectioned views of FIGS. 9 and 10) have generally ribbed profiles so as to give rise to so-to-speak star-shaped cross-sections. Moreover, it will be appreciated that, as shown in the drawings, the shape of the connecting wall between the input opening 12 and the expulsion opening 13 is not usually precisely frusto-conical but has, in general, a tapered shape with a generally curved profile.

It will also be appreciated that the embodiment shown by the drawings relates to a product P which is spherical and hence has a circular cross-section, such as, for example, the pralines of the type currently sold with the trade names Ferrero Rocher, Pasticceria Raffaello, etc. by companies of the Ferrero group. Clearly, however, the cross-sectional profile of the moulding cavity 11 is adapted to the characteristics of the product P. Purely to give an example, for a product P constituted, for example by a chocolate having a generally "chest-like" profile (again by way of example, this may be the food products sold with the trade names of "Pocket Coffee" and "Mon Cheri", again by companies of the Ferrero group), the moulding cavity 11 will have a generally rectangular or square profile. It is thus quite clear that the present invention is in no way limited to the formation of cases with circular cross-sectional profiles. The same remark also applies to the generally pleated shape of the peripheral wall of the case. If, for example, it is desired to produce a housing case with a smooth wall, the moulding cavity 11 will not generally have a ribbed wall. In general, it is possible to confer on the aforesaid wall an appearance which identifies the shape to be imparted to the case for housing the product P.

A further element of the device 10 is a male element 14 of a shape which is complementary to the shape of the cavity 11 locally.

The element 14 is constituted substantially by a punch-like body which can:

- engage, with its end edge, the region of the connection between the pieces 1 and 2 in the portion most immediately adjacent the product P, and
- urge the product P wrapped in the pieces 1 and 2 into the moulding cavity 11 (see the sequence of FIGS. 5 and 6) descending into the moulding cavity 11 for a certain distance or portion d so as to perform the shaping of the rim connecting the pieces 1 and 2 in accordance with the shape defined by the profile of the wall of the moulding cavity 11.

This penetration movement is performed under the effect of drive means (for example, linear actuators) which are not shown since they are of known type.

Since the shape of the male element or punch 14 is complementary to that of the moulding cavity 11, all of the remarks made above with regard to the selection of the shape of the moulding cavity and to the possible variants in this connection apply identically (naturally in complementary manner) to the element 14.

The male element 14 is preferably not intended to penetrate the entire extent of the moulding cavity 11 but only the portion d thereof; the complementary nature of the shapes of these elements consequently concerns substantially the portion d in question.

Once its travel into the cavity 11 has been completed, and the shaping of the wall of the case has thus been performed, the element 14 can then be returned upwardly (see FIG. 7) under the action of its drive means. However, the product P, which is housed in the wrapper formed by the pieces 1 and 2 with the connecting rim formed in the shape of the case, remains in the cavity 11. The male element 14 can thus safely be disengaged from the cavity 11 and from the product P which remains in the cavity, without problems connected with the "de-moulding" operation.

In order to leave the cavity 11 through the outlet opening 13, the product P must therefore still perform a certain downward travel inside the lower portion—that is, the portion of smaller dimensions—of the cavity 11.

This situation explains the optional presence and function of the third element included in the device 10 in the embodiment shown. In practice, this is a rod 17 having at its top a small plate 18 which can initially receive (FIG. 5) and support, adjacent the input opening 12 of the cavity 11, the product P housed in the pieces 1 and 2 connected to one another along the rim formed by the homologous regions 1*c* and 2*a*.

The rod 17 can be lowered gradually in coordination with the penetration of the male element 14 and can then continue its travel, as shown schematically in FIG. 7, pulling the product P housed in the wrapper downwards by its lower case-like portion. This takes place in a manner such as to cause the product P to emerge through the output opening 13 of the cavity 11.

For this purpose, the rod 17 is usually configured (in known manner) in the form of a gripping element, for example, a vacuum gripping element. It thus has a longitudinal cavity 19 which opens in the plate 18 with a suction opening 20. The longitudinal duct 19 is connected to a source S of subatmospheric pressure (also of known type and thus shown purely schematically solely in FIG. 7) so as to cause the product P housed in the wrapper to be held on the plate 18 and to follow the plate 18 during its downward movement. This movement is imparted to the plate 18 by a drive element shown schematically in this case in the form of a gear 21 acting on a corresponding toothed portion 22 of the rod 17.

Experts in the art will appreciate that the relative movements of the product P housed in the wrapper, of the cavity 11, of the male element 14, and of the rod 17, with the associated elements, may in fact be brought about in a manner other than that described, that is, by providing for the movement of the male element 14 and of the rod 17, whilst the cavity 11 remains stationary. What is important for the purposes of achieving the result described is the relative movement between the above-mentioned parts; clearly therefore, this relative movement may be achieved in a different manner, for example, by moving the cavity 11 along the axis connecting the openings 12 and 13, whilst one or more of the other elements described is kept stationary. These are in any case variants within the capabilities of an expert in the art which do not therefore need to be described in detail herein.

The result achieved by the expulsion of the product P housed in the wrapper formed by the pieces 1 and 2 through the outlet opening 13 is that a certain narrowing of the top or mouth edge, and hence of the free edge, of the case-like portion of the wrapper is brought about, bringing this edge towards the corresponding portion of the piece 1 which surrounds the product P directly. The corresponding shrinkage of the mouth edge of the case is permanent owing to the general plastic behaviour of the pieces 1 and 2.

It will be appreciated that this operation on the case is not essential. When the material constituting one or both of the pieces 1 and 2 has resilient or substantially resilient behaviour with respect to small deformations, the above-mentioned operation is not generally carried out. Clearly, in this case, the male element 14 may penetrate the cavity 11 completely and not merely in the portion d, as shown in the appended drawings. In this case, it would also be possible to consider not providing for downward extraction of the product P and of the case-shaped wrapper, but instead providing for its upward extraction through the inlet opening 12. In this case, the cavity 11 may also be in the form of a blind cavity and hence without the presence of the expulsion opening 13.

Precisely because of the way in which the male element 14 operates (see FIG. 6 in particular), the central region of the piece 2 which is intended to constitute the base wall of the case retains its flat shape and thus constitutes a base on which the product P wrapped in the wrapper can rest firmly without danger of turning over or rolling.

This distinguishes the solution according to the invention from the solutions of EP-A-0 082 952 and EP-A-0 591 742 in which the wrapper copies the shape of the product precisely (a spherical shape in the case of a spherical praline) and thus cannot provide a support base. In this connection, it will be noted that the availability of a flat support base in the solution of EP-A-0 790 184 (the other of the documents cited at the beginning of the present description) results purely from the particular shape of the product described therein and not from a characteristic of the wrapper itself.

Basically, therefore, in the wrapper thus formed, the second piece 2 comprises a central flat region forming a support surface for the wrapper and for the product P wrapped therein. The peripheral region 2*a* surrounds this central region in a generally case-like configuration so as to have an inner surface and an outer surface relative to the case-like shape. The first piece 1 with its domed or cup-like shape defines a cavity for housing the product P and has its respective peripheral portion 1*c* connected to the inner surface of the peripheral portion 2*a* of the piece 2 which is coextensive therewith.

The solution according to the invention may be adopted either with pieces 1 and 2 made of the same material and/or with identical colour characteristics, or with pieces 1 and 2 made of different materials and/or having different colour characteristics, for example, with a piece 1 of metallized material (for example, of a gold or silver colour) and a piece 2 made of a material, for example, of a brown colour and possibly not metallized. In the latter case, the overall effect is thus wholly comparable to that of a product wrapped in a tight-fitting wrapper of metallized material housed in a brown case.

A further aspect of interest is that, in the solution according to the invention, the peripheral edge of the case-like portion does not actually perform the function of housing the product P (and the portion of the wrapper which surrounds it). This function is in fact performed by the encapsulation of the product P between the two pieces 1 and. 2. It is consequently possible to form case-like portions the peripheral walls of which are of quite limited height, in contrast with conventional housing cases which usually (and also so as to be, to a certain extent historically reminiscent of hand-made confectionery) have a height at least equal and in some cases decidedly greater than half of the height of the product housed in the case. The possibility offered by the invention of making the peripheral walls of the case quite "low" and thus having a height substantially lower than the homologous height of the product P translates into an ability to show off the product P to better advantage by displaying a larger portion thereof.

Naturally, the principle of the invention remaining the same, the details of construction and forms of embodiment may be varied widely with respect to those described and illustrated, without thereby departing from the scope of the present invention.

What is claimed is:

1. A method of wrapping a product in a wrapper made of sheet material, comprising the steps of:

providing a first sheet and a second sheet of wrapping material, shaping the first sheet to a configuration substantially complementary to that of the product, inserting the product in the first sheet thus shaped, applying the second sheet to the product, connecting the first sheet and the second sheet in homologous peripheral regions, and further shaping the mutually connected first sheet and second sheet, characterized in that it further comprises the steps of:

shaping the first sheet into the configuration substantially complementary to that of the product in a manner such that the first sheet thus shaped can house the product substantially in its entirety, applying the second sheet to the product, keeping the second sheet in a substantially flat condition at least in a respective central region surrounded by the respective peripheral region, and shaping the mutually connected homologous peripheral regions relative to the central portion of the second sheets which is kept flat, so as to form a holding cup comprising a central flat section acting as a base and an annular rim projecting upwardly from said base and surrounding at a radial distance the wrapped product.

2. A method according to claim 1, comprising the step of shaping the mutually connected homologous peripheral regions with a generally pleated pattern.

3. A method according to claim 1, wherein, after the forming, the wrapper holding cup for housing the product is further shaped by pushing its free edge towards the first sheet and the product housed therein.

4. A method according to claim 1, wherein the first sheet is selected so as to have substantially larger dimensions than the second sheet.

5. A method according to claim 1, comprising the step of selecting dimensions for the first sheet such that, once the first sheet has been shaped to a configuration substantially complementary to that of the product, the first sheet still comprises a substantially flat peripheral region which can define one of the homologous peripheral regions.

6. A method according to claim 1, wherein the first sheet is shaped by forming between a die and a punch.

7. A method according to claim 1, wherein the first sheet is shaped by a drawing operation.

8. A method according to claim 1, wherein the second sheet is applied to the product without shaping operations.

9. A method according to claim 1, wherein the first sheet and the second sheet are connected to one another sealingly by a connecting operation selected from the group constituted by:

gluing with the application of added material, heat-sealing, and ultrasound welding.

10. A method according to claim 1, comprising the step of coating the first sheet and the second sheet with a layer of hot-melting material on the connecting surfaces.

11. A method according to claim 10, wherein the removal step is performed simultaneously with the connection of the first sheet and the second sheet or in a subsequent step.

12. A method according to claim 1, comprising the step of removing the portions of the homologous peripheral regions which are outside the mutual connection region.

13. A method according to claim 1, comprising the step of selecting a metallic material, preferably aluminium, for the first sheet and for the second sheet.

14. A method according to claim 1, wherein the first sheet and the second sheet are of substantially identical colour.

15. A method according to claim 1, wherein the first sheet and the second sheet are selected so as to be, at least partially, of different colours.

16. A device for implementing the method according to claim 1, characterized in that it comprises:

shaping means for shaping the first sheet to a configuration substantially complementary to that of the product, connecting means for connecting the second sheet, which is arranged so as to cover the cavity defined by the first sheet and housing the product, and further shaping means for shaping the first sheet and the second sheet around the product, the shaping means are configured in a manner such that the first sheet shaped to the said configuration can house the product substantially in its entirety, the connection means are configured so as to connect the first sheet and the second sheet in respective homologous peripheral regions, the second sheet being kept in a substantially flat condition at least in a central region surrounded by the respective peripheral region, and the further shaping means are configured for acting on the homologous regions connected to one another by the connecting means adjacent the product housed in the first sheet, the further shaping means comprising complementary shaping elements which can shape the mutually connected homologous regions of the first sheet and of the second sheet towards the product so as to form a holding cup for housing the product.

17. A device according to claim 16, wherein the further shaping means comprise:

a forming cavity which can be entered by the product housed in the substantially closed wrapper, starting from the central region of the second sheet, and a male element which can penetrate the forming cavity like a punch, acting on the wrapper adjacent the product in the mutually connected homologous regions of the first sheet and of the second sheet so as to compress the mutually connected homologous regions between the wall of the forming cavity and the male element, performing the further shaping.

18. A device according to claim 17, wherein the male element has a generally punch-like configuration.

19. A device according to claim 17, wherein the forming cavity and the male element have complementary tapered shapes, the taper appearing in the direction in which the male element penetrates the forming cavity.

20. A device according to claim 17, wherein the forming cavity has an input opening and an outlet opening for the product housed in the wrapper, the penetration of the male element taking place from the input opening towards the outlet opening.

21. A device according to claim 20, wherein:

the forming cavity and the male element have complementary shapes such as to allow the male element to penetrate a certain portion of the forming cavity disposed between the input opening and the outlet opening, the arrangement being such that the male element can be disengaged from the homologous regions of a wrapper subjected to the further shaping, the wrapper and the product housed therein being retained in the forming cavity, and pulling means are provided for causing the wrapper and the product housed therein, which are retained in the forming cavity, to advance towards the outlet opening, bringing about further bending of the free edge of the case-shaped wrapper portion for housing the product towards the product, as a result of the general taper of the forming cavity.

22. A device according to claim 21, wherein the pulling means comprise an abutment element which can cooperate with the central region of the second sheet and is movable into the forming cavity in coordination with the penetration movement of the male element.

23. A device according to claim 21, wherein the pulling means are configured as gripping elements which can act on the wrapper.

24. A device according to claim 23, wherein the pulling means are configured as an element for gripping by means of subatmospheric pressure.

25. A device according to claim 16, wherein the further shaping means have a substantially pleated surface shape in the portions cooperating with the homologous regions of the first sheet and of the second sheet.

26. A device according to claim 16, wherein the shaping means comprise a die and a punch.

27. A device according to claim 16, wherein the shaping means comprise a drawing tool.

28. A device according to claim 16, wherein the connecting means are selected from the group constituted by:

means for gluing with the supply of external material, heat-sealing means, ultrasound welding means.

29. A device according to claim 16, comprising means for removing the portions of the first sheet and of the second sheet which extend beyond the mutually connected homologous regions.

30. A device according to claim 29, wherein the connecting means are configured so as to remove the portions of the first sheet and of the second sheet which extend beyond the homologous regions.

31. A food product wrapped in a wrapper constituted by a first sheet and a second sheet connected to one another in respective homologous peripheral regions, wherein:

the second sheet comprises a central flat region defining a support surface for the wrapper and for the product contained therein, with its peripheral region surrounding the central region so as to form a housing body with a generally case-shaped configuration, the peripheral region having respective inner and outer surfaces relative to the case-shaped configuration and surrounding at a radial distance the wrapped product, and the first sheet defines a cavity for housing the product and its peripheral region is substantially coextensive with and connected to the inner surface of the respective peripheral region of the second sheet.

32. A product according to claim 31, wherein the respective mutually connected homologous regions are generally pleated.

33. A product according to claim 31, wherein the peripheral wall of the case-shaped housing body has a height substantially lower than the homologous height of the product.

34. A product according to claim 31, wherein the first sheet and the second sheet have a coating of hot-melting material at least on the surfaces of the mutually connected homologous regions.

35. A product according to claim 31, wherein the first sheet and the second sheet are made of identical material.

36. A product according to claim 31, wherein at least one of the first sheet and the second sheet is made of metallic sheet material.

37. A product according to claim 36, wherein the metallic material is based on aluminium.

38. A food product according to claim 31, wherein the first sheet and the second sheet are of identical colour.

39. A product according to claim 31, wherein the first sheet and the second sheet are at least partially of different colours so that the outer surface of the peripheral wall of the case-shaped housing body has a colour contrasting with the first sheet.

* * * * *